US007644716B2

(12) United States Patent
Hosoya et al.

(10) Patent No.: US 7,644,716 B2
(45) Date of Patent: Jan. 12, 2010

(54) APPARATUS FOR MANUFACTURING A CARBONACEOUS HEAT SOURCE CHIP

(75) Inventors: Nobuo Hosoya, Utsunomiya (JP); Hajime Ohinata, Utsunomiya (JP); Yasuo Baba, Tokyo (JP); Masaaki Kobayashi, Tokyo (JP); Kazuei Takahashi, Ibaraki (JP)

(73) Assignee: Japan Tobacco Inc., Tokyo (JP)

( * ) Notice: Subject to any disclaimer, the term of this patent is extended or adjusted under 35 U.S.C. 154(b) by 424 days.

(21) Appl. No.: 11/417,020

(22) Filed: May 4, 2006

(65) Prior Publication Data

US 2006/0201057 A1 Sep. 14, 2006

Related U.S. Application Data

(63) Continuation of application No. PCT/JP2004/016407, filed on Nov. 5, 2004.

(30) Foreign Application Priority Data

Nov. 13, 2003 (JP) ..... 2003-384148

(51) Int. Cl.

| | |
|---|---|
| ***A24D 1/10*** | (2006.01) |
| *B29C 47/88* | (2006.01) |
| *F26B 3/08* | (2006.01) |
| *F26B 7/00* | (2006.01) |

(52) U.S. Cl. ..... 131/351; 34/360; 34/419; 264/211.12

(58) Field of Classification Search ..... None
See application file for complete search history.

(56) References Cited

U.S. PATENT DOCUMENTS

| | | | | |
|---|---|---|---|---|
| 3,589,163 | A * | 6/1971 | Byrne et al. | 72/270 |
| 5,065,776 | A | 11/1991 | Lawson et al. | |
| 5,108,277 | A * | 4/1992 | Dixon | 425/72.1 |
| 5,560,376 | A * | 10/1996 | Meiring et al. | 131/369 |
| 5,727,571 | A | 3/1998 | Meiring et al. | |
| 6,443,160 | B1 | 9/2002 | Boldrini et al. | |

FOREIGN PATENT DOCUMENTS

| | | | |
|---|---|---|---|
| EP | 0 481 192 | A1 | 4/1992 |
| EP | 0 562 474 | A2 | 9/1993 |
| JP | 4-246365 | A | 9/1992 |
| JP | 6-7139 | A | 1/1994 |
| JP | 6-189733 | A | 7/1994 |
| JP | 8-332067 | A | 12/1996 |
| RU | 2156098 | C2 | 9/2000 |

* cited by examiner

*Primary Examiner*—Philip C Tucker
*Assistant Examiner*—Michael J Felton
(74) *Attorney, Agent, or Firm*—Birch, Stewart, Kolasch & Birch, LLP

(57) ABSTRACT

Apparatus for manufacturing a carbonaceous heat source chip, capable of drying an extrusion-molded carbonaceous heat source rod to proper hardness and supplying the same to a heat insulating material-wrapping device. The apparatus includes a hollow pipe that forms a conveying path for transporting the carbonaceous heat source rod continuously extrusion-molded by an extrusion molding machine, to the heat insulating material-wrapping device. The apparatus forms an airflow running through the hollow pipe by means of an air amplifier, and transports the carbonaceous heat source rod while drying the rod by using the airflow.

10 Claims, 6 Drawing Sheets

APPARATUS FOR MANUFACTURING A CARBONACEOUS HEAT SOURCE CHIP

This application is a Continuation of copending PCT International Application No. PCT/JP2004/016407 filed on Nov. 5, 2004, which designated the United States, and on which priority is claimed under 35 U.S.C. §120. This application also claims priority under 35 U.S.C. §119(a) on Patent Application No(s). 2003-384148 filed in Japan on Nov. 13, 2003. The entire contents of each of the above documents is hereby incorporated by reference.

TECHNICAL FIELD

The present invention relates to an apparatus for manufacturing a carbonaceous heat source chip installed in a tip end portion of a cigarette or the like together with an aerosol generating material and used for heating the aerosol generating material.

BACKGROUND ART

As an alternative to a cigarette and the like, a smoking article formed by wrapping a carbonaceous heat source chip 1, an aerosol generating material 2 such as tobacco leaves, and a mouthpiece (filter) 3 in wrapping paper 4 into a cigarette-like shape as illustrated in FIG. 9 has been suggested (see Unexamined Japanese Patent Publication No. 6-189733 for example). The smoking article is so designed that aerosol is generated from the aerosol generating material 2 by heat produced from the carbonaceous heat source chip 1, and that the aerosol is smoked through the mouthpiece 3.

In this case, the carbonaceous heat source chip 1 is obtained by mixing and kneading carbon powder serving as fuel and a combustion regulator (graphite, calcium carbonate, sodium carbonate, etc.) with binder (ammonium alginate, methyl cellulose, pectin, etc.), extruding the same to form a carbonaceous heat source rod 5, and wrapping the rod 5 in a heat insulating material 6, such as glass fiber (see Unexamined Japanese Patent Publication No. 6-7139 for example). The carbonaceous heat source rod 5 has, for example, a diameter of 3 to 5 mm. As shown in the cross section in FIG. 10, the carbonaceous heat source rod 5 has a plurality of grooves 7 axially formed on its circumferential surface. The grooves 7 function as air conduits when the aerosol generating material 2 is heated by the carbonaceous heat source rod 5, and serve to cause the carbonaceous heat source rod 5 to exhibit a desired combustion characteristic.

The carbonaceous heat source rod 5 extruded from an extrusion molding machine has moist and pliable qualities, so that it is usually guided to a heat insulating material-wrapping device by means of an air foil conveyor without crushing the grooves 7 of the carbonaceous heat source rod 5. The air foil conveyor blows out air from the bottom of the conveying path obliquely toward the downstream of the transporting direction. By so doing, the conveyor forms an air layer that prevents contact between an article and the bottom of the conveying path, and meanwhile transports the article by using the airflow.

However, even if the carbonaceous heat source rod 5 is transported to the heat insulating material-wrapping device by the air foil conveyor without crushing the carbonaceous heat source rod 5, especially the grooves 7 formed on the circumferential surface of the rod 5, the grooves 7 are occasionally crushed as illustrated in FIG. 11 when the circumferential surface of the carbonaceous heat source rod 5 is wrapped in the heat insulating material 6 by the heat insulating material-wrapping device. In such a case, there arises the problem that the desired combustion characteristic possessed by the carbonaceous heat source rod 5, namely carbonaceous heat source chip 1, cannot be retained, and the like.

In order to prevent such a problem, one idea is, for example, to dry the carbonaceous heat source rod 5 to certain hardness by using the airflow from the air foil conveyor during transportation of the air foil conveyor. The air foil conveyor, however, blows out air from the bottom of a groove forming the conveying path. Therefore, the there is the problem that the carbonaceous heat source rod 5 is greatly dried in the side of the rod 5 facing the conveying path and is not dried uniformly. Another idea is to alter the composition of the carbonaceous heat source rod 5 or to reduce the moisture content of the carbonaceous heat source rod 5 at the time of extrusion molding. However, these methods cause new problems that the extrusion molding itself becomes difficult, that the combustion characteristic and the flavor are changed, and the like.

DISCLOSURE OF THE INVENTION

It is an object of the present invention to provide an apparatus for manufacturing a carbonaceous heat source chip, capable of effectively drying a carbonaceous heat source rod to such proper hardness that the shape thereof is not deformed and supplying the rod to a heat insulating material-wrapping device when manufacturing the carbonaceous heat source chip by wrapping an extrusion-molded carbonaceous heat source rod in a heat insulating material.

In order to achieve the above object, the apparatus for manufacturing a carbonaceous heat source chip according to the present invention comprises an extrusion molding machine for extrusion-molding a carbonaceous heat source rod having grooves axially extending in a circumferential surface thereof, a heat insulating material-wrapping device for wrapping the circumferential surface of the carbonaceous heat source rod extruded from the extrusion molding machine in a heat insulating material, a hollow pipe forming at least part of a conveying path for transporting the carbonaceous heat source rod extruded from the extrusion molding machine to the heat insulating material-wrapping device, and at least one air amplifier for making an airflow running through in the hollow pipe. The apparatus is characterized by transporting the carbonaceous heat source rod while drying the same by using the airflow.

With the thus constructed apparatus for manufacturing a carbonaceous heat source chip, since the carbonaceous heat source rod extruded from the extrusion molding machine is transported while being dried by the airflow running through the hollow pipe, it is possible to evenly and efficiently dry the entire circumferential surface of the carbonaceous heat source rod. Therefore, when the carbonaceous heat source rod is wrapped in a heat insulating material by the heat insulating material-wrapping device to manufacture the carbonaceous heat source chip, the grooves formed in the circumferential surface of the carbonaceous heat source rod are not crushed and deformed. Consequently, the combustion characteristic of the carbonaceous heat source chip can be fully assured.

According to the present invention, the conveying path formed of the hollow pipe can be relatively freely designed. Specifically, the hollow pipe can be disposed in a loop-like shape between the extrusion molding machine and the heat insulating material-wrapping device. This downsizes the apparatus for manufacturing a carbonaceous heat source chip as a whole and therefore reduces an installation space for the manufacturing apparatus.

Air amplifiers may be disposed at an inlet of the hollow pipe and in the middle of the hollow pipe. This makes it possible to form an airflow having pressure that smoothly transports the carbonaceous heat source rod through the entire length of the hollow pipe, to dry the carbonaceous heat source rod properly by using the airflow, and to manufacture a carbonaceous heat source chip excellent in combustion characteristic.

It is preferable that the air amplifier be provided with a static pressure adjusting hole for discharging part of air to adjusting an airflow rate in the hollow pipe.

In the present invention, there may be provided space between the extrusion molding machine and the conveying path to form slack in the carbonaceous heat source rod supplied from the extrusion molding machine to the conveying path, and the wrapping operation speed (wrapping speed) of the heat insulating material-wrapping device may be regulated by a controller so that slack length of the carbonaceous heat source rod becomes prescribed length. In this case, the carbonaceous heat source rod can be supplied to the heat insulating material-wrapping device while the quality of the carbonaceous heat source rod is stably maintained, regardless of fluctuations in extrusion speed of the carbonaceous heat source rod from the extrusion molding machine.

The apparatus of the present invention may include a movable carrying path that is movable between a connecting position where the movable carrying path is disposed between the extrusion molding machine and the carrying path and a retreating position where the movable carrying path draws away from between the extrusion molding machine and the conveying path, and a cutting device disposed immediately downstream of the extrusion molding machine so as to face the conveying path. In this case, as long as the moisture content and extrusion speed of the carbonaceous heat source rod are unstable, for example, right after the activation of the extrusion molding machine, the movable carrying path is retreated to the retreating position so that the carbonaceous heat source rod continuously extruded from the extrusion molding machine is discharged, for example, into a collection box instead of being supplied to the conveying path. Thereafter, when the moisture content and extrusion speed of the carbonaceous heat source rod become stable, the carbonaceous heat source rod is cut by the cutting device on the extrusion molding machine side and dropped into a collection box. Subsequently, the movable carrying path is positioned in the connecting position where the extrusion molding machine and the conveying path are connected to each other, and the carbonaceous heat source rod freshly extruded from the extrusion molding machine is guided to the conveying path. Accordingly, the carbonaceous heat source rod begins to be supplied to the heat insulating material-wrapping device. The movable carrying path is then retreated again. More preferably, the wrapping operation speed of the heat insulating material-wrapping device is reduced. As a result, there generates slack in the carbonaceous heat source rod because of its weight, and the wrapping operation speed of the heat insulating material-wrapping device is regulated so that the slack length becomes prescribed length.

BEST MODE OF CARRYING OUT THE INVENTION

An apparatus for manufacturing a carbonaceous heat source chip according to one embodiment of the present invention will be described below with reference to the drawings.

Figure 1:
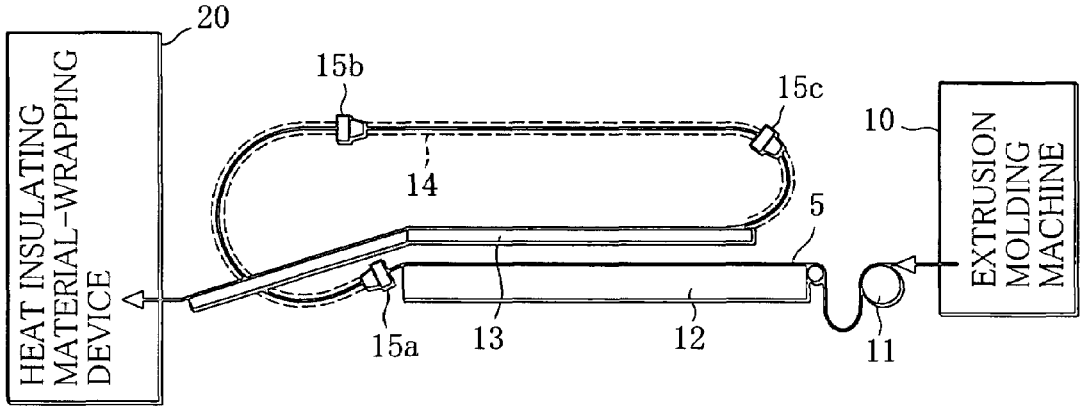
FIG. 1 is a schematic view showing a substantial portion of an apparatus for manufacturing a carbonaceous heat source chip according to one embodiment of the present invention.

As illustrated in FIG. 1, the apparatus for manufacturing a carbonaceous heat source chip has an extrusion molding machine 10 that continuously fabricates a carbonaceous heat source rod 5 and a heat insulating material-wrapping device 20 that wraps the carbonaceous heat source rod 5 in a heat insulating material 6 having prescribed thickness, which is made of glass fiber or the like. As the extrusion molding machine 10 and the heat insulating material-wrapping device 20 have been conventionally well known, detail descriptions thereof will be omitted.

The apparatus for manufacturing a carbonaceous heat source chip is basically constructed so that the moist carbonaceous heat source rod 5 that is continuously extrusion-molded by the extrusion molding machine 10 is sequentially supplied through a conveying roller 11, and first and second air foil conveyors 12 and 13 to the heat insulating material-wrapping device 20.

The apparatus for manufacturing a carbonaceous heat source chip according to the present invention is characterized in that, for example, a transparent and acrylic hollow pipe 14 is disposed between the first air foil conveyor 12 and the second air foil conveyor 13 as a conveying path for the carbonaceous heat source rod 5, and that an airflow running through the hollow pipe 14 is produced by air amplifiers 15*a*, 15*b* and 15*c* to dry the carbonaceous heat source rod 5 by using the airflow while transporting the same. Specifically, the hollow pipe 14 is disposed in a loop-like shape as the conveying path having prescribed length, which connects between the first and second air foil conveyors 12 and 13 arranged parallel to each other.

The air amplifiers that make airflows in the hollow pipe 14 include the main air amplifier (first air amplifier) 15*a* disposed at an inlet of the hollow pipe 14 and auxiliary air amplifiers (second air amplifiers) 15*b* and 15*c* disposed in two respective locations in the middle of the hollow pipe 14. The main air amplifier 15*a* serves to make an airflow having prescribed pressure at the inlet of the hollow pipe 14 and run the airflow through the hollow pipe 14 by using compressed air. The auxiliary air amplifiers 15*b* and 15*c* serve to amplify the rate (pressure) of the airflow by using the compressed air introduced from the outside. By using the airflow formed in the hollow pipe 14 by the air amplifiers 15*a*, 15*b* and 15*c*, the carbonaceous heat source rod 5 delivered from the first air foil conveyor 12 is transported and guided to the second air foil conveyor 13. Moreover, by using the airflow, the carbonaceous heat source rod 5 is dried to proper hardness for the duration of transportation of the carbonaceous heat source rod 5 from the first air foil conveyor 12 to the second air foil conveyor 13.

The proper hardness of the carbonaceous heat source rod 5 is such hardness that grooves 7 formed on the circumferential surface of the carbonaceous heat source rod 5 are not crushed and deformed when the carbonaceous heat source rod 5 is wrapped in the heat insulating material 6 made of glass fiber or the like by the heat insulating material-wrapping device 20, and at the same time such hardness as not to hinder the cutting when the product obtained by wrapping the carbonaceous heat source rod 5 in the heat insulating material 6 is cut with a cutter into pieces having prescribed length to serve as carbonaceous heat source chips. To be concrete, it is the hardness indicated as about 200 grams in folding strength in this embodiment.

Figure 2:
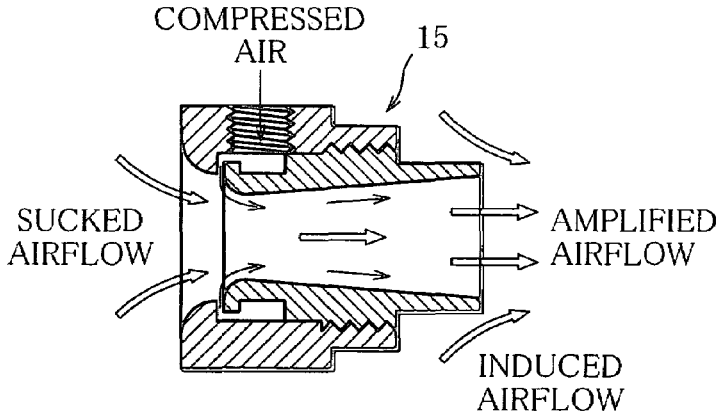
FIG. 2 is a cross-sectional view of a basic constitution of an air amplifier used in the manufacturing apparatus shown in FIG. 1.

The air amplifier that makes the airflow in the hollow pipe 14, for example, the main air amplifier 15*a* basically includes a main body in which a conduit having a diameter decreased from an outlet side toward an inlet side in a tapered shape is formed, and slits formed along an inner wall of the main body, and has a structure in which the compressed air introduced from a compressed air feeding port formed in a circumferential wall of the main body is ejected through the slits into the conduit, for example, as in a schematic sectional constitution shown in FIG. 2. The main air amplifier 15*a* induces a large amount of the airflow at the outlet side thereof by using a small amount of compressed air ejected from the slit as power source. That is, the main air amplifier 15*a* generates a strong vacuum force in the conduit of the main body to suck in air from the inlet of the conduit, and ejects a large amount of the amplified air from the outlet of the conduit. The auxiliary air amplifiers 15*b* and 15*c* have similar basic constitutions. In addition, an air amplifier of this type is manufactured, for example, by SANWA ENTERPRISE COMPANY, LTD. in the name of "ROUND BLOW".

Figure 3:
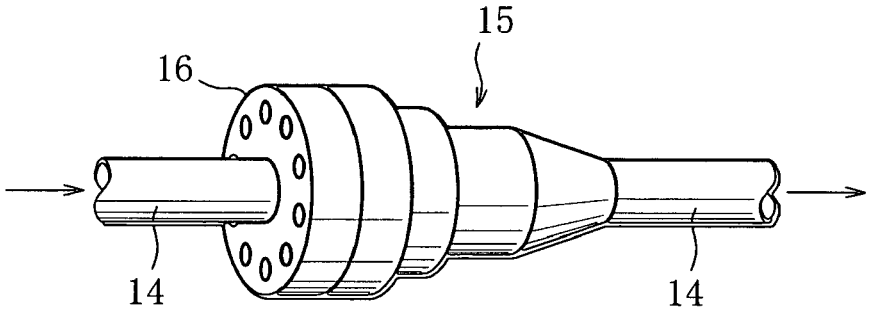
FIG. 3 is a view showing a connecting constitution of the air amplifier with respect to a hollow pipe forming a conveying path.

The connection between the air amplifiers 15*a* to 15*c*, especially the auxiliary air amplifiers 15*b* and 15*c*, and the hollow pipe 14 is completed, for example as illustrated in FIG. 3 showing the auxiliary air amplifier 15*b*, by interposing an attachment 16 upstream from the air amplifier, the attachment 16 being provided with static pressure adjusting holes that discharge part of the airflow to adjust the static pressure thereof. In this embodiment, each of the air amplifiers 15*a*, 15*b* and 15*c* is constructed as illustrated in FIG. 3. By using the airflows produced and adjusted in pressure by the air amplifiers 15*a*, 15*b* and 15*c*, respectively, the carbonaceous heat source rod 5 is continuously transported from the inlet of the hollow pipe 14 toward the outlet thereof. At the same time, by using the same airflows, the carbonaceous heat source rod 5 is evenly air-dried from the circumferential surface thereof.

Consequently, with the thus constructed apparatus for manufacturing a carbonaceous heat source chip, since the airflows run through the hollow pipe 14 while contacting the circumferential surface of the carbonaceous heat source rod 5 when the moist and pliable carbonaceous heat source rod 5 is transported by using the airflows, the carbonaceous heat source rod 5 is evenly air-dried by degree from the circumferential surface thereof. Furthermore, the airflows simply run through the hollow pipe 14 along the circumferential surface of the carbonaceous heat source rod 5, which provides high drying efficiency with respect to the carbonaceous heat source rod 5. Therefore, without increasing the length of the conveying path formed of the hollow pipe 14, a good drying effect can be expected even if the path has relatively short length. Accordingly, the carbonaceous heat source rod 5 can be easily and reliably dried to such hardness that it does not crushed and deformed, for the carbonaceous heat source rod 5 is wrapped in the heat insulating material 6 by the heat insulating material-wrapping device 20.

With the above-described constitution, the hollow pipe 14 can be formed in the loop-like shape, so that it is not necessary to widely separate the extrusion molding machine 10 and the heat insulating material-wrapping device 20 from each other. This causes an effect of reducing a space for installation of the apparatus for manufacturing a carbonaceous heat source chip, including the extrusion molding machine 10 and the heat insulating material-wrapping device 20, and the like.

The following experiment was conducted for the purpose of confirming the effect of the apparatus for manufacturing a carbonaceous heat source chip according to the present invention. First of all, a resultant obtained by mixing and kneading calcium carbonate, carbon and a binder, in a composition ratio (%) of 40:50:10 was extrusion-molded at room temperature (24° C.) by the extrusion molding machine 10 of the manufacturing apparatus constructed as in FIG. 1. As a result, a rod-like sample A (carbonaceous heat source rod 5) with an external diameter of 4.3 mm, in which one central through hole with a diameter of 0.7 mm, six large grooves located therearound and six small grooves were formed, was obtained. The sample A right after extrusion molding was taken out, and the moisture (moisture at the time of molding) thereof was measured. The extrusion-molded sample A was air-dried while being transported from the extrusion molding machine 10 through the first air foil conveyor 12, the hollow pipe 14 and the second air foil conveyor 13 toward the heat insulating material-wrapping device 20, and was taken out before the heat insulating material-wrapping device 20. Subsequently, the sample A was measured as described below in folding strength (hardness), moisture (moisture at the time of the heat insulating material wrapping), temperature (temperature at the time of the heat insulating material wrapping), ventilation resistance, and flammability.

Samples B and C containing calcium carbonate, carbon and the binder in a composition ratio (%) of 50:40:10 and 55:35:10, respectively, were subjected to the same measurement. Table 1 shows measurement results about the samples A, B and C. The same measurement was carried out with respect to the samples A, B and C by using a manufacturing apparatus having a similar constitution, except that it is not provided with the hollow pipe 14. Measurement results are shown in Table 2.

TABLE 1

| Sample | Folding strength (Hardness) | Moisture at molding | Moisture at heat insulating material wrapping | Temperature at heat insulating material wrapping | Ventilation resistance | Flammability |
|---|---|---|---|---|---|---|
| A | 258 g | 27.1% | 25.0% | 18° C. | 46 $mmH_2O$ | 1.2 seconds |
| B | 196 g | 26.1% | 24.5% | 19° C. | 42 $mmH_2O$ | 1.2 seconds |
| C | 198 g | 25.8% | 24.0% | 16° C. | 44 $mmH_2O$ | 1.2 seconds |

TABLE 2

| Sample | Folding strength (Hardness) | Moisture at molding | Moisture at heat insulating material wrapping | Temperature at heat insulating material wrapping | Ventilation resistance | Flammability |
|---|---|---|---|---|---|---|
| A | 123 g | 27.1% | 26.8% | 32° C. | 80 $mmH_2O$ | 1.6 seconds |
| B | 113 g | 26.1% | 25.8% | 33° C. | 72 $mmH_2O$ | 1.5 seconds |
| C | 123 g | 25.8% | 25.5% | 32° C. | 68 $mmH_2O$ | 1.5 seconds |

Figure 4:
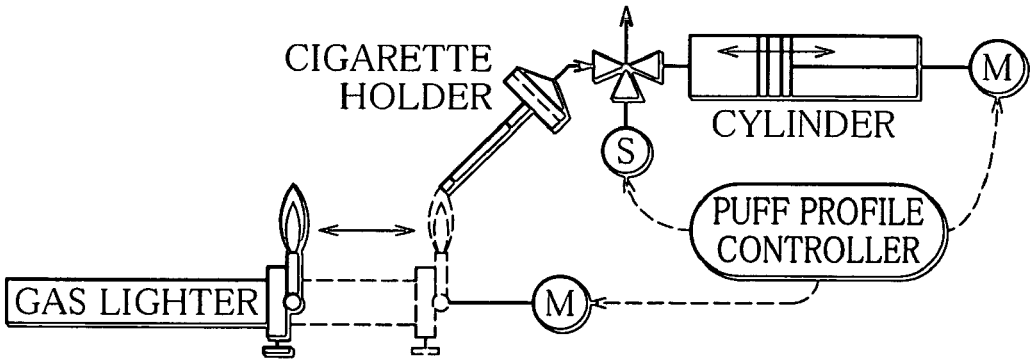
FIG. 4 is a view showing a schematic constitution of a cigarette measuring device for measuring the flammability of a carbonaceous heat source rod.
Figure 9:
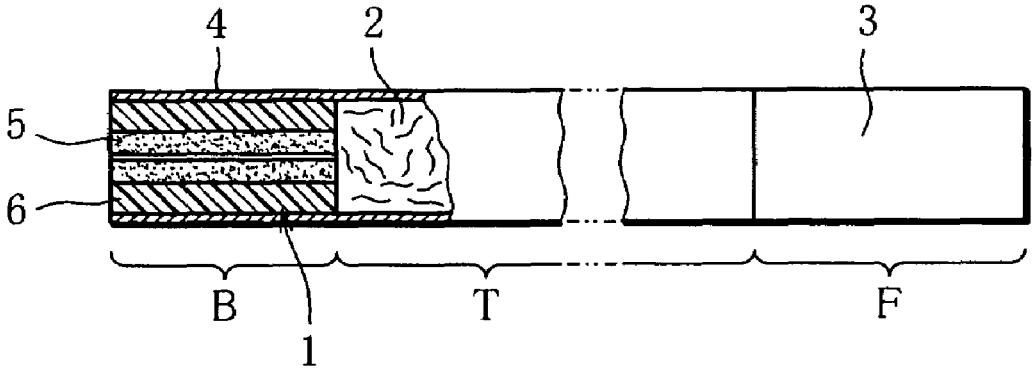
FIG. 9 is a view showing a structure example of a smoking article using the carbonaceous heat source rod.
Figure 10:
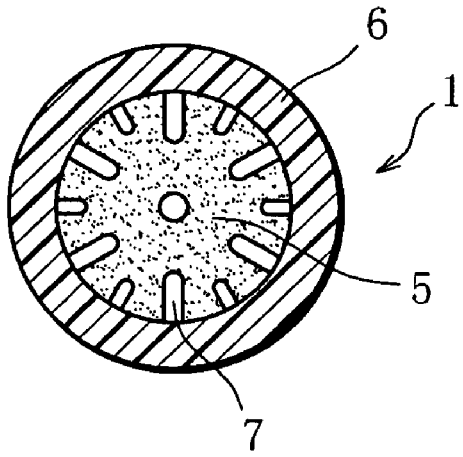
FIG. 10 is a view showing a cross-sectional structure of the carbonaceous heat source chip obtained by wrapping the carbonaceous heat source rod in a heat insulating material.
Figure 11:
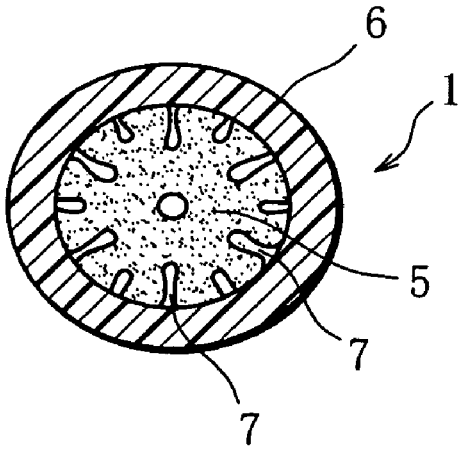
FIG. 11 is a cross-sectional view of the carbonaceous heat source chip in a state where grooves formed in the circumferential surface of the carbonaceous heat source rod are crushed.

In the experiments, the ventilation resistance was measured at an airflow amount of 17.5 mL/second using the carbonaceous heat source rod 5 removed from the manufacturing apparatus and cut into pieces having a length of 72 mm. In respect of folding strength (hardness), the carbonaceous heat source rod 5 was placed on supports separated off by a gap of 10 mm from each other, and the maximum folding load, which was obtained by pressing down the carbonaceous heat source rod 5 at the center thereof at a speed of 0.883 mm/second by means of a pressuring member, was measured as the folding strength. As to flammability, in a state where a smoking article having a structure shown in FIG. 9, which includes the carbonaceous heat source rod 5, was attached to a cigarette holder of a cigarette measuring device shown in FIG. 4, puff action (sucking action) was performed for the duration of proper suction time period at piston speed that had been set at 17.5 mL/second. Subsequently, the carbonaceous heat source rod 5 was ignited at the first puff. When suction was performed after 15 seconds on the same conditions as in the first puff, the suction time period required to ignite the entire carbonaceous heat source rod 5 was measured as flammability.

As shown in the experiment example, in the case that the carbonaceous heat source chip was fabricated by means of the manufacturing apparatus according to the present invention, it was possible to increase the folding strength (hardness) about 1.6 to 2 times higher and to decrease a moisture content by about 2 percent, compared to the manufacturing apparatus without the hollow pipe. A moisture-decreasing rate in a case that the present invention was not employed was about 0.3 percent, and the rod was scarcely dried. Temperature could be lowered to about 16 to 19° C. due to a cooling effect caused by moisture evaporation in an environment where the room temperature was 24° C. This temperature reduction is also considered to be a factor for the increase of hardness of the carbonaceous heat source chip. It was confirmed that the crush (deformation) of the grooves formed on the circumferential surface of the rod, which is caused when the rod is wrapped in the heat insulating material 6, was prevented as much as the carbonaceous heat source rod 5 is hardened, and that the degradation of the ventilation resistance was prevented.

It cannot be denied that extrusion speed of the carbonaceous heat source rod (extrusion-molded article) 5 according to the extrusion molding machine 10 fluctuates due to various factors. The fluctuation of the extrusion speed of the carbonaceous heat source rod 5 from the extrusion molding machine 10 leads to quality deterioration of the carbonaceous heat source chip fabricated by the heat insulating material-wrapping device 20. If the extrusion speed of the carbonaceous heat source rod 5 from the extrusion molding machine 10 is lower than wrapping operation speed of the heat insulating material-wrapping device 20, the carbonaceous heat source rod 5 is thinly lengthened or broken. To the contrary, if the extrusion speed of the carbonaceous heat source rod 5 from the extrusion molding machine 10 is higher than the wrapping operation speed of the heat insulating material-wrapping device 20, the carbonaceous heat source rod 5 protrudes from the conveying path, and the hollow pipe 14 is clogged. Therefore, conventionally, the condition (tension and the like) of the carbonaceous heat source rod 5 on the conveying path is visually checked, and the wrapping operation speed of the heat insulating material-wrapping device 20 is manually fine adjusted. However, the adjusting work is bothersome, and moreover it is difficult to carry out an adjustment with high accuracy.

Figure 5:
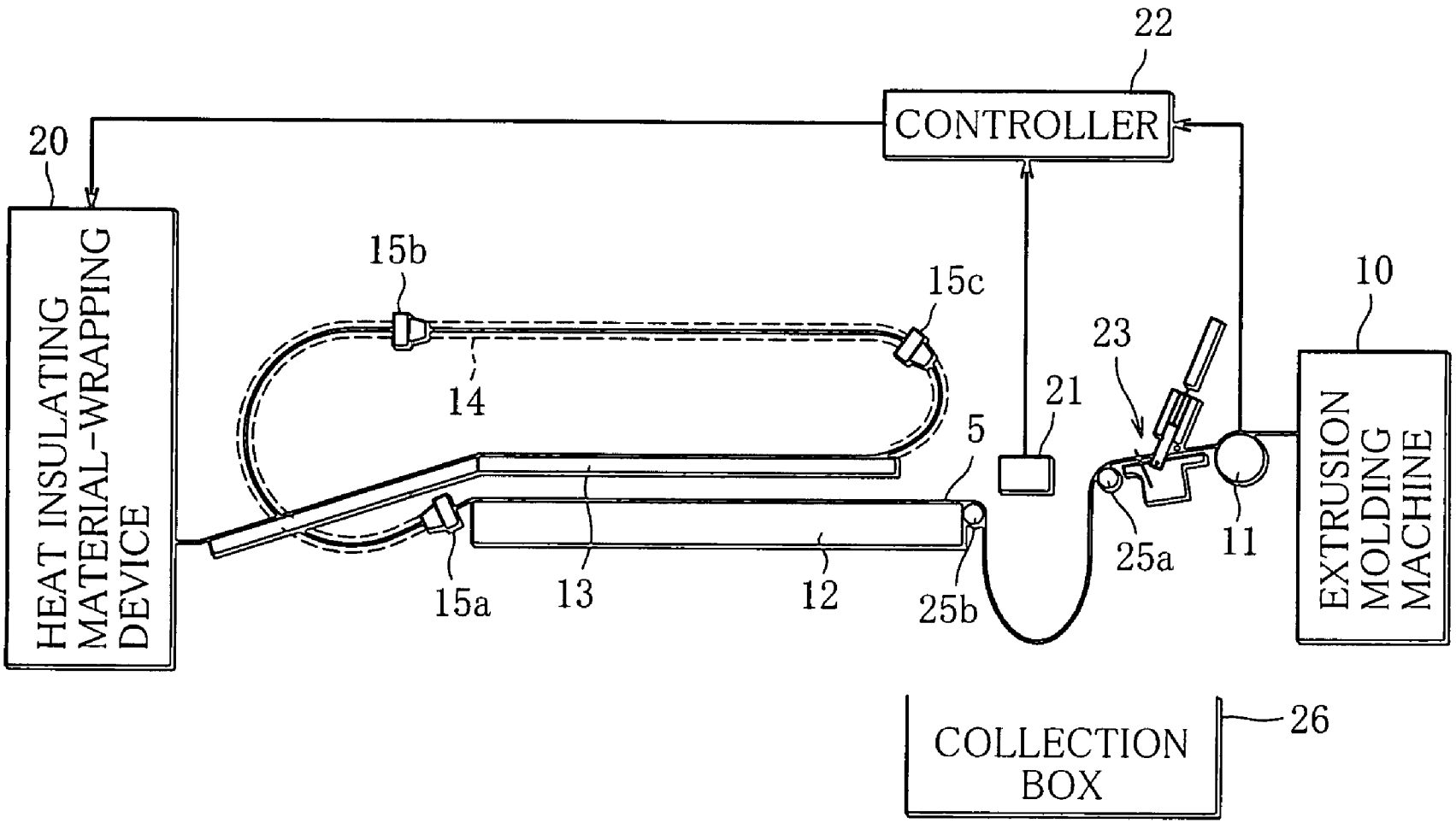
FIG. 5 is a schematic constitution view showing another embodiment of the present invention.

In order to solve the above-described problems, in the apparatus of the present invention, there is formed a space having prescribed length between the extrusion molding machine 10 and the first air foil conveyor 12, and prescribed slack is formed in the carbonaceous heat source rod 5 that is continuously extruded from the extrusion molding machine 10 to be produced in the space, as in the constitution shown in FIG. 5. The length of the slack (slack length) of the carbonaceous heat source rod 5 is detected by a detector 21, such as an ultrasonic distance sensor. Subsequently, the wrapping operation speed of the heat insulating material-wrapping device 20 is regulated by a controller 22 so that the slack length becomes prescribed length that has been preset.

To be specific, a cutting device 23 that properly cuts the carbonaceous hat source rod 5 is disposed downstream from the conveying roller 11. The carbonaceous heat source rod 5 having qualities that is unsuitable for the supply to the heat insulating material-wrapping device 20, for example, which is extrusion-molded by the extrusion molding machine 10 at an early stage of commencement of the operation of the extrusion molding machine 10, is discarded into a collection box 26. Thereafter, at the point when the carbonaceous heat source rod 5 becomes stable in qualities and is in a state suitable for the supply to the heat insulating material-wrapping device 20, the cutting device 23 is activated, to thereby supply the carbonaceous heat source rod 5 through the conveying path to the heat insulating material-wrapping device 20. There is formed a space portion having prescribed length between a conveying roller 25*a* disposed at an outlet of the cutting device 23 and a conveying roller 25*b* disposed at an inlet of the first air foil conveyor 12 so that slack of the carbonaceous heat source rod 5 is formed between the conveying rollers 25*a* and 25*b* due to the weight thereof. The detector 21 is disposed above the space portion and detects the slack length of the carbonaceous heat source rod 5.

Figure 6:
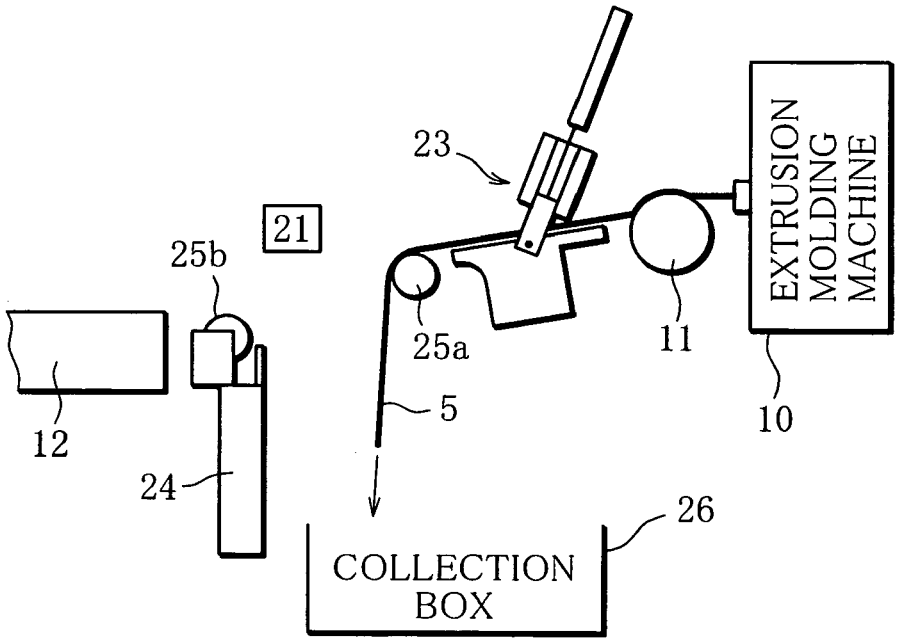
FIG. 6 is a view showing a rod discharging process during supply starting control of the carbonaceous heat source rod in the apparatus for manufacturing a carbonaceous heat source chip, illustrated in FIG. 5.
Figure 7:
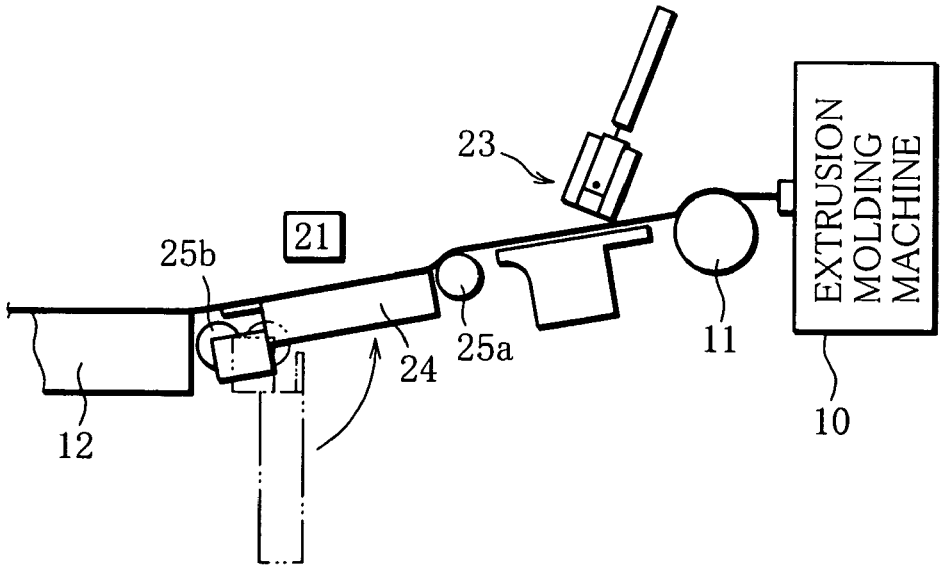
FIG. 7 is a view showing a rod supply starting process in the supply starting control of the carbonaceous heat source rod.

More specifically, in the space portion, there is provided a third air foil conveyor (movable carrying path) 24 that can be optionally located between the conveying rollers 25*a* and 25*b* as illustrated in FIG. 6. In a lower position of the space portion, there is disposed the collection box 26 that receives the carbonaceous heat source rod 5 discharged through the conveying roller 25*a*. The third air foil conveyor 24 is usually located in a retreating position where it draws apart from between the conveying rollers 25*a* and 25*b* so that the space between the conveying rollers 25*a* and 25*b* is opened and the connection between the conveying rollers 25*a* and 25*b* by means of the third air foil conveyor 24 is released. Only when the supply of the carbonaceous heat source rod 5 to the heat insulating material-wrapping device 20 begins, the third air foil conveyor 24 is located in a connecting position where it connects between the conveying rollers 25*a* and 25*b* as illustrated in FIG. 7, thereby connecting the outlet of the cutting device 23 and the inlet of the first air foil conveyor 12 to each other.

In the thus constructed apparatus for manufacturing a carbonaceous heat source chip, when the moisture content and extrusion speed of the carbonaceous heat source rod 5 are not stable as right after the operation of the extrusion molding machine 10 begins, the third air foil conveyor 24 is first located in the retreating position as illustrated in FIG. 6, and the carbonaceous heat source rod 5 having qualities unsuitable for the supply to the heat insulating material-wrapping device 20, which is continuously extruded from the extrusion molding machine 10, is discharged into the collection box 26. In this process, the extrusion speed of the carbonaceous heat source rod 5 is detected from rotational speed of the conveying roller 11 or the like, to thereby monitor the stability of the operation thereof.

When the qualities of the carbonaceous heat source rod 5 become suitable for the supply to the heat insulating material-wrapping device 20 and become stable, the operation of the heat insulating material-wrapping device 20 is started. Subsequently, the cutting device 23 is activated as illustrated in FIG. 6. At this moment, part of the carbonaceous heat source 5, which is located downstream from the cutting device 23, is discharged into the collection box 26 as the carbonaceous heat source rod 5 is in the process of being discharged into the collection box 26. Immediately after the cutting device 23 is activated, the third air foil conveyor 24 is located in the connecting position as illustrated in FIG. 7 so that the outlet of the cutting device 23 and the inlet of the first air foil conveyor 12 are connected with each other. Accordingly, the carbonaceous heat source rod 5 located upstream from the cutting device 23 at the time of the activation of the cutting device 23 is guided through the third air foil conveyor 24 to the first air foil conveyor 12 and is supplied through the first air foil conveyor 12 to the hollow pipe 14. Following this part of carbonaceous heat source rod 5, the carbonaceous heat source rod 5 that has been freshly extruded from the extrusion molding machine 10 after the activation of the cutting device 23 is supplied to the hollow pipe 14 in the same manner. The carbonaceous heat source rod 5 is guided from the hollow pipe 14 through the second air foil conveyor 13 to the heat insulating material-wrapping device 20. In this process, the extrusion speed of the carbonaceous heat source rod 5 is detected from the rotational speed of the conveying roller 11. Based on the extrusion speed thus detected, the wrapping speed of the heat insulating material-wrapping device 20 is regulated by the controller 22. The detector 21 detects the carbonaceous heat source rod 5 located on the third air foil conveyor 24 as well as the third air foil conveyor 24. This detection indicates that there is no slack. In such a state, the detector 21 then generates a control signal so that the wrapping operation speed of the heat insulating material-wrapping device 20 is reduced.

As to the supply starting control of the carbonaceous heat source rod 5, a proper actuator (not shown) is controlled by proper control means, for example, the controller 22, while an operating condition of the extrusion molding machine 10 is monitored, and the time required until the qualities of the carbonaceous heat source rod 5 become stable is estimated. By so doing, the third air foil conveyor 24 can be located in the retreating position or the connecting position.

Figure 8:
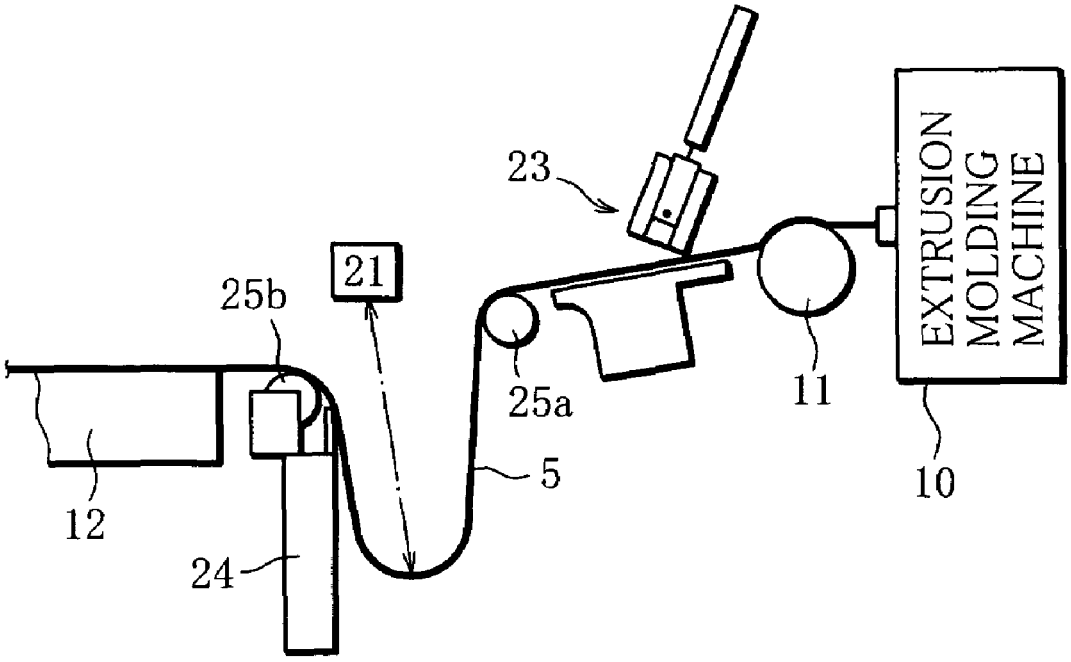
FIG. 8 is a view showing a rod slack length-regulating process performed after the supply starting control of the carbonaceous heat source rod.

When the tip end portion of the carbonaceous heat source rod 5 that has become stable in qualities reaches the heat insulating material-wrapping device 20, at about the same time as this timing, the third air foil conveyor 24 is located in the retreating position as illustrated in FIG. 8. As a result, the carbonaceous heat source rod 5 is brought into a state extending between the conveying rollers 25*a* and 25*b* without being supported on the third air foil conveyor 24. In this state, however, since the wrapping operation speed of the heat insulating material-wrapping device 20 is regulated to be lowered as described, the carbonaceous heat source rod 5 gradually loosens between the conveying rollers 25*a* and 25*b* due to difference between the wrapping operation speed and the extrusion speed of the carbonaceous heat source rod 5 in the extrusion molding machine 10. The carbonaceous heat source rod 5 forms U-shaped slack due to the weight thereof as illustrated in FIG. 8. The detector 21 detects this slack length.

The controller 22 increases the wrapping operation speed of the heat insulating material-wrapping device 20 once the slack length of the carbonaceous heat source rod 5 becomes equal to prescribed length, and subsequently regulates the wrapping operation speed so that the slack length equals the prescribed length. This regulation adjusts the wrapping operation speed of the heat insulating material-wrapping device 20 according to the extrusion speed while absorbing fluctuations in the extrusion speed of the extrusion molding machine 5 by using the slack of the carbonaceous heat source rod 5. Consequently, the wrapping operation speed is synchronized with the operation of the extrusion molding machine 10, so that the fabrication of a carbonaceous heat source chip using the heat insulating material-wrapping device 20 is stably performed.

Since the wrapping operation speed of the heat insulating material-wrapping device 20 is regulated while using the slack of the carbonaceous heat source rod 5, it is possible to efficiently fabricate the carbonaceous heat source chip that is stable in quality together with the proper drying effect of the carbonaceous heat source rod 5 using the hollow pipe 14. The above-mentioned regulation provides an advantage that optimum regulation can be easily realized according to the qualities of the carbonaceous heat source rod 5, compared to the case in that the extrusion speed of the extrusion molding machine 10 is detected to directly regulate the wrapping operation speed of the heat insulating material-wrapping device 20.

The present invention is not limited to the above-described embodiment. Although airflows are formed within the hollow pipe 14 by means of the three air amplifiers 15, the number of air amplifiers 15 to be installed is determined in accordance with the conveying path length of the hollow pipe 14. The transporting speed thereof may be set by adjusting the airflow amounts and the like. In addition, various modifications can be made without deviating from the gist of the present invention.

The invention claimed is:

1. An apparatus for manufacturing a carbonaceous heat source chip, comprising an extrusion molding machine for extrusion-molding a carbonaceous heat source rod having grooves axially extending on a circumferential surface thereof, a heat insulating material-wrapping device for wrapping the circumferential surface of the carbonaceous heat source rod extruded from said extrusion molding machine in a heat insulating material, said apparatus further comprising:

a hollow pipe forming at least part of a conveying path for transporting the carbonaceous heat source rod continuously extrusion-molded by said extrusion molding machine from said extrusion molding machine toward said heat insulating material-wrapping device; and at least one air amplifier for making an airflow running through said hollow pipe in a transporting direction of the carbonaceous heat source rod, wherein:

the carbonaceous heat source rod is transported by using the airflow while being dried by the airflow, and the airflow produced by the air amplifier flows only in a direction identical with the transporting direction of the carbonaceous heat source rod and contacts the entire circumferential surface of the carbonaceous heat source rod.

2. The apparatus for manufacturing a carbonaceous heat source chip according to claim 1, wherein said hollow pipe is disposed in a loop-like shape between said extrusion molding machine and said heat insulating material-wrapping device.

3. The apparatus for manufacturing a carbonaceous heat source chip according to claim 1, provided in the conveying path with a first air foil conveyor for delivering the carbonaceous heat source rod extruded from said extrusion molding machine to said hollow pipe and a second air foil conveyor for supplying the carbonaceous heat source rod from said hollow pipe to said heat insulating material-wrapping device.

4. The apparatus for manufacturing a carbonaceous heat source chip according to claim 3, wherein said hollow pipe is disposed in a loop-like shape between said first air foil conveyor and said second air foil conveyor.

5. The apparatus for manufacturing a carbonaceous heat source chip according to claim 1, wherein said at least one air amplifier is disposed at an inlet of said hollow pipe.

6. The apparatus for manufacturing a carbonaceous heat source chip according to claim 1, wherein said at least one air amplifier is disposed in the middle of said hollow pipe.

7. The apparatus for manufacturing a carbonaceous heat source chip according to claim 1, wherein said at least one air amplifier includes a first air amplifier disposed at an inlet of said hollow pipe, for generating an airflow in the inside of said hollow pipe, and a second air amplifier disposed in the middle of said hollow pipe, for increasing the airflow running through said hollow pipe.

8. The apparatus for manufacturing a carbonaceous heat source chip according to claim 1, wherein said at least one air amplifier has a static pressure adjusting hole for discharging part of air to adjust an airflow rate in said hollow pipe.

9. The apparatus for manufacturing a carbonaceous heat source chip according to claim 1, wherein there is provided space between said extrusion molding machine and the conveying path to form slack in the carbonaceous heat source rod supplied from said extrusion molding machine to the conveying path, and wrapping operation speed of said heat insulating material-wrapping device is regulated by control means so that slack length of the carbonaceous heat source rod becomes equal to prescribed length.

10. The apparatus for manufacturing a carbonaceous heat source chip according to claim 1, the apparatus further comprises a movable carrying path that is movable between a connecting position where the movable carrying path is disposed between said extrusion molding machine and the conveying path and a retreating position where the movable carrying path draws away from between said extrusion molding machine and the conveying path, and a cuffing device disposed immediately downstream from said extrusion molding machine so as to face the conveying path, wherein:

said movable carrying path is maintained in the retreating position until moisture content and extrusion speed of the carbonaceous heat source rod continuously extruded from said extrusion molding machine become stable so as to be suitable for wrapping operation in said heat insulating material-wrapping device; and after the moisture content and extrusion speed of the carbonaceous heat source rod become stable, the carbonaceous heat source rod is cut by said cuffing device, and subsequently said movable carrying path is located in the connecting position, to thereby start the supply of the carbonaceous heat source rod to said heat insulating material-wrapping device.

* * * * *

UNITED STATES PATENT AND TRADEMARK OFFICE

CERTIFICATE OF CORRECTION

PATENT NO. : 7,644,716 B2
APPLICATION NO. : 11/417020
DATED : January 12, 2010
INVENTOR(S) : Hosoya et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 461 days.

Signed and Sealed this

Sixteenth Day of November, 2010

David J. Kappos

David J. Kappos
*Director of the United States Patent and Trademark Office*